US005593463A

United States Patent [19]

Gambini et al.

[11] Patent Number: 5,593,463

[45] Date of Patent: Jan. 14, 1997

[54] FUEL COMPOSITION

[75] Inventors: Paola Gambini; Emilio Gatti, both of Milan, Italy

[73] Assignee: Agippetroli S.p.A., Rome, Italy

[21] Appl. No.: 536,445

[22] Filed: Sep. 29, 1995

[30] Foreign Application Priority Data

Oct. 13, 1994 [IT] Italy ..... MI94A2089

[51] Int. Cl.$^6$ ..... C10L 1/16

[52] U.S. Cl. ..... 44/300; 44/418; 44/432; 44/459; 585/10; 585/14

[58] Field of Search ..... 44/459, 300, 432, 44/418; 585/10, 14; C10L 1/16

[56] References Cited

U.S. PATENT DOCUMENTS

| | | | |
|---|---|---|---|
| 3,252,771 | 5/1966 | Clough et al. | 585/10 |
| 3,749,560 | 7/1973 | Perilstein | 585/10 |
| 4,375,973 | 3/1983 | Rossi et al. | 44/459 |
| 4,420,647 | 12/1983 | Hammond | 585/10 |
| 4,846,848 | 7/1989 | Miles et al. | 44/403 |

FOREIGN PATENT DOCUMENTS

0290088A1 11/1988 European Pat. Off. .

*Primary Examiner*—Prince Willis, Jr.
*Assistant Examiner*—Cephia D. Toomer
*Attorney, Agent, or Firm*—George P. Hoare, Jr.; Rogers & Wells

[57] ABSTRACT

Fuel composition for internal combustion engines which comprises a larger portion of fuel and a smaller quantity of a composition of hydrocarbon oligomers almost totally saturated, characterized in that the above composition of almost totally saturated hydrocarbon oligomers: 1) is obtained by the oligomerization and subsequent hydrogenation of a hydrocarbon composition comprising basically $C_{13}$–$C_{18}$, preferably $C_{15}$–$C_{16}$, internal oligomers, in a quantity of more than 90% by weight, 2) is basically without any possible hydrocarbons having a number of carbon atoms equal to or less than 13, 3) has a viscosity at 100° C. of betweem 5.0 and 12.0 cSt, particularly from 7.3 to 8.4 cSt.

12 Claims, No Drawings

FUEL COMPOSITION

The present invention relates to a composition which comprises a greater quantity of gasoline that can be used for internal combustion engines and a smaller quantity of at least one additive which comprises a polymerization product of internal olefins.

There are often numerous substances capable of forming deposits which are present in fuels based on hydrocarbons.

During the operation of internal combustion engines, these substances, in contact with the fuel, tend to form deposits on particular areas of the engine, for example feeding circuits, intake and exhaust valves. In the case of injection engines, the above deposits preferably form on the intake valves and injectors themselves.

The above deposits influence the functioning of the engine in different ways. For example deposits on the carburator cause an increase in the ratio between fuel and air in the gaseous mixture which reaches the combustion chamber. This causes an increase in the unburnt hydrocarbons and quantity of carbon monoxide discharged from the chamber. In addition the high ratio between fuel and air reduces the mileage of the vehicle.

Deposits on the injection valves, on the other hand, cause a reduction in the quantity of gaseous mixture which reaches the combustion chamber, thus causing a loss of power. In addition the deposits on the valves can cause a weakening of the valves themselves.

Finally the above deposits can be polverized and enter the combustion chamber with the consequent possibility of mechanical damage to the pistons, piston linings rings and engine head.

The formation of these deposits can be prevented by the use of fuels to which substances with a deterging action have been added.

A wide variety of detergent additives which keep the areas mainly subject to the formation of deposits clean, are commercially available; in this way the performance and duration of the engine are enhanced.

The above detergents have the advantage of also having dispersing properties.

These additives are often conveied by carriers which have the function of facilitating the deposit of the additive on the above-mentioned parts of the engine, synergizing its action. Typical carriers are mineral oils, polyisobutene (PIB) and the polyalpha-olefins described in U.S. Pat. No. 4,846,848. The above document discloses that oligomers of hydrogenated polyalpha-olefins (mainly mixtures of trimers, tetramers and pentamers) of alpha-olefins having from 6 to 12 carbon atoms, generally from 8 to 12, can be used.

The continual development of engine performance however requires an ever-increasing efficiency of the above additives.

IT-A-20106 A/80 describes the polymerization, or more precisely, the oligomerization of internal olefins, particularly olefins having a number of Carbon atoms of between 12 and 20, even more preferably between 15 and 18. The above polymerization takes place in the presence of suitable catalysts, particularly adducts of $AlCl_3$ with esters, complexes of $BF_3$ with alcohols, organic and inorganic acids. As shown by the mass spectrometer and bromometric titrations, the oligomers generally have a double bond for each molecule. The oligomerization usually produces mixtures of dimers and trimers, the higher oligomers generally being less than 5–10%.

The unsaturated oligomers are subsequently hydrogenated; the hydrogenation is carried out in the presence of hydrogen and catalysts which are well-known to experts in the field. The products obtained, without possible light products are called PIO.

It has now been found, and the present invention relates thereto, that a particular fraction of PIO deriving from the polymerization of basically $C_{13}$–$C_{20}$, especially $C_{15}$–$C_{16}$, internal olefins, having a viscosity at 100° C. of between 5 and 12 cSt, preferably between 7.3 and 8.4 cSt, is useful as a fuel additive for internal combustion engines. More specifically the above fraction of hydrogenated internal polyolefins has excellent carrying properties for detergent additives—dispersers usually used in fuel compositions.

In accordance with this, the present invention relates to a fuel composition for internal combustion engines which comprises a larger portion of fuel and a smaller quantity of a composition of hydrocarbon oligomers almost totally saturated, characterized in that the above composition of almost totally saturated hydrocarbon oligomers:

1) is obtained by the oligomerization and subsequent hydrogenation of a hydrocarbon composition comprising basically $C_{13}$–$C_{18}$, preferably $C_{15}$–$C_{16}$, internal oligomers, in a quantity of more than 90% by weight,
2) is basically without any possible hydrocarbons having a number of carbon atoms equal to or less than 13,
3) has a viscosity at 100° C. of betweem 5.0 and 12.0 cSt, particularly from 7.3 to 8.4 cSt.

The term PIO means the composition of almost totally saturated hydrocarbon oligomers, "almost totally saturated" meaning a degree of unsaturation of less than 10%, preferably less than 5% and basically without the starting olefinic composition or light reaction by-products.

The composition of almost totally saturated hydrocarbon oligomers of the present invention, which satisfies the above viscosity requirements, can consist of the crude product deriving from the oligomerization and subsequent hydrogenation (without possible nonreacted monomers or other light by-products), or can be a distillation cut, either head or tail, of the above crude product.

It is preferable however to distill the crude product (either before or after, preferably after, the hydrogenation step) to eliminate traces of light products, for example non-reacted olefins, light paraffins and isoparaffins. The term "light" means hydrocarbons in general having a number of carbon atoms either equal to or less than the starting hydrocarbon mixture.

It is important for the almost totally saturated hydrocarbon mixture to have a viscosity of between 5 and 12 cSt at 100° C., preferably between 7.3 and 8.4 cSt.

The PIOs can be obtained (IT-A-20106 A/80) by oligomerization in the presence of adducts of $AlCl_3$ with esters or complexes of $BF_3$ with alcohols, organic and inorganic acids, dispersions of $AlCl_3$ on supports consisting of silica or alumina. It is preferable however to use complexes of $BF_3$ with inorganic acids. With this process it is usually possible to obtain a conversion degree of the starting olefins of between 70 and 90%, making it necessary to eliminate the above light fractions.

This step preferably consists in removing the above light products as distillation heads, and is preferably carried out after the hydrogenation step.

Depending on the desired viscosity, the PIO obtained after the stripping of the light products, can be used directly, or, if fractions with a greater viscosity are required, the PIO thus obtained is subjected to further distillation, preferably at reduced pressure. In this way the light fractions with a lesser viscosity are eliminated and the distillation residue, obviously more viscous, is used.

For example, from a PIO 6 (i.e. a PIO having about 6 cSt of viscosity at 100° C.) it is possible to obtain a PIO 8 (or a PIO having about 8 cSt of viscosity at 100° C.) by eliminating a quantity of distillation heads corresponding to about 50% of the starting PIO 6.

It is implicit that to obtain more viscous fractions, a greater quantity of distillation heads will be eliminated.

The PIOs thus obtained basically consist of dimers and trimers, the sum of the two generally being higher than 90–95%. The percentage distribution between dimers and trimers depends on various parameters, such as temperature, catalytic system and duration of the reaction.

As fuel additive, the effective quantity of PIO is between 100 and 1200 ppmw (parts per million by weight), preferably between 200 and 800 ppmw.

The fuel compositon of the present invention can additionally contain smaller quantities of detergent additives such as oil-soluble aliphatic polyamines (U.S. Pat. No. 3,649,229), alkenyl succinimides of polyamines (U.S. Pat. No. 3,574,576), Mannich bases of polyisobutenylphenols (U.S. Pat. No. 4,160,648), aminocarbamates of polyoxyalkylenes (U.S. Pat. No. 4,247,301), polyamines of polyoxyalkylenes (U.S. Pat. No. 3,873,278), ammonium salts of carboxylic acids, polyoxyalkylenic fatty amines and amino carbonates (U.S. Pat. No. 5,248,315). The polyamines usually contain a chain of polymeric olefin having a molecular weight of between 500 and 10,000, preferably between 600 and 1,300, bound to the nitrogen or alkylenic radical which binds the aminic nitrogen atoms.

Typical polyamines are those represented by the formula (I)

$$H(R)N\text{-}R'\text{-}(NH\text{-}R')_x\text{-}N(R'')_2 \qquad (I)$$

wherein R is the polyolefinic chain, preferably polyisobutene with a molecular weight of between 600 and 1,300; R' is an alkylenic chain with from 1 to 8, particularly 3, carbon atoms; R" is hydrogen or a lower alkyl, especially methyl; x is from 0 to 5, preferably zero.

The fuel composition of the present invention, particularly gasoline, more specifically unleaded gasoline, can also contain other additives, for example of the phenolic type, such as 2,6-diterbutyl phenol, or phenylenediamines, for example N,N'-di-secbutyl-p-phenylene diamine, or anti-knock additives, as described for example in U.S. Pat. No. 4,477,261 and EP-A-151.621, and flame-rate enhancers, such as earth-alkaline salts of alkenyl succinimides.

The fuel composition of the present invention comprises a larger quantity of fuel useful for internal combustion engines. The above fuels have a boiling point within the temperature range of gasoline, i.e. from 30° C. to 230° C., and basically consist of saturated, olefinic and aromatic hydrocarbons.

These hydrocarbon fractions can derive from straight-run gasoline, from mixtures of synthetically produced aromatic hydrocarbons, hydrocarbon feedstocks subjected to thermal or catalytic cracking, petroleum fractions subjected to hydrocracking or hydrocarbons subjected to catalytic reforming.

The octane number of the hydrocarbons is not critical and is generally higher than 65. Smaller quantities of alcohols, ketones, ethers and esters may also be present in the fuel. Obviously the fuel is preferably without water as water prevents adequate combustion.

The PIOs can be added to the fuel together with other additives. A convenient method consists in preparing a concentrate of PIO with other additives and then adding this concentrate in the desired quantity to produce the required final concentration of additive.

The present invention further relates to a concentrate which can be conveniently added to the fuel comprising a diluent soluble in the fuel itself and the composition of almost totally saturated hydrocarbon oligomers of the present invention; the above concentrate can optionally also contain a polyamine soluble in oil and a polyisobutene, or alternatively other additives with a detergent function such as those described above.

These concentrates preferably contain from 20 to 80% by weight of internal polyolefin, from 1 to 30% of a polyamine and from 1 to 30% of diluent.

Convenient diluents for the above concentrates are diluents which are compatible with the fuel, such as hydrocarbons (for example heptane), alcohols or ethers, such as methanol, ethanol, propanol, 2-butoxyethanol or methyl ter-butyl ether. The diluent is preferably an aromatic hydrocarbon such as toluene, xylene, relative mixtures or mixtures of toluene and xylene with an alcohol. The concentrate can also optionally contain a de-hazer, particularly a ethoxylated phenol-formaldehyde resin. The de-hazer, if used, can be contained in the concentrate in a quantity of between 0.1 and 2% with respect to the diluent.

The following examples provide a better understanding of the present invention.

EXAMPLE 1

A commercial product called MX 2106 sold by Mixoil and produced by Enichem Augusta Industriale is used.

The above PIO derives from the oligomerization of a composition of internal $C_{15}$–$C_{16}$ olefins.

The above MX 2106 has the following characteristics:

| | |
|---|---|
| Density at 15° C. | 8.834 kg/l |
| Viscosity at 100° C. | 5.8 cSt |
| Viscosity at 40° C. | 31.5 cSt |
| Viscosity at −30° C. | 2750 cSt |
| Viscosity index | 128 |
| Pour Point | −48° C. |
| Noack Test | 8.4% weight. |

EXAMPLE 2

The product MX 2106 of example 1 is subjected to fractionation on a fine film evaporator at reduced pressure (about 1.5–1.6 mmHg) in order to obtain two fractions, one at the head with a low viscosity (about 4 cSt at 100° C., called PIO 4 and which cannot be used in the present invention) and one at the bottom with a higher viscosity (between 7.0 and 8.5 cSt at 100° C., called PIO 8).

Table 1A shows the distillation conditions and table 1B the characterization of the feed and head and bottom fractions obtained starting from the same feed, but distilling in one case (test A) about 50% of the charge and in the other (test B) about 40% of the charge. In table 1B, the viscosity is the kinematic viscosity expressed in cSt measured at various temperatures, I.V. is the viscosity index, NOACK is the volatility measurement (method CEC-L-40T87).

TABLE 1A

| | TEST A | | TEST B | |
|---|---|---|---|---|
| | Head | Bottom | Head | Bottom |
| Temperature °C. | 246 | 260 | 246 | 260 |
| Press. (mmHg) | 1.6 | | 1.5 | |
| Balance (% w) | 49.1 | 50.9 | 39.5 | 60.5 |

TABLE 1B

| | TEST A | | TEST B | | |
|---|---|---|---|---|---|
| | Head | Bottom | Head | Bottom | Feed |
| Visc. 100° C. | 4.9 | 7.914 | 4.188 | 7.225 | 5.771 |
| Visc. 40° C. | 20.28 | 51.08 | 19.58 | 44.4 | 31.29 |
| I.V. | 119 | 123 | 118 | 124 | 128 |
| Visc. −30° C. | 1630 | 6500 | 1530 | 5100 | 2750 |
| NOACK (% w) | 12.14 | 5.4 | 13.32 | 6.57 | 9.12 |

The residue of distillation A consists of 42% of dimers and 58% of trimers and higher.

MOTORISTIC EVALVATIONS

Table 2 shows the results of the motoristic evaluations using gasoline to which the commercial PIO 6 of example 1 and a PIO 8 of example 2, precisely the residue of distillation A, have been added.

Test 1 of table 2 shows the data of gasoline with no additions, test 2 of gasoline to which PIO 8 distillation residue A of example 2 has been added, test 3 of gasoline to which a commercial polyisobutylene amine (additive A), has been added, repeated tests 4 and 5 of gasoline to which a mixture of PIO 8 and additive A, has been added, test 6 a gasoline to which the PIO 6 of example 1 has been added.

TABLE 2

| Additive | quant. | Suct. valve deposits | | | | (mg/valv.) |
|---|---|---|---|---|---|---|
| (type) | mg/kd | 1 | 2 | 3 | 4 | average |
| 1) — | — | 210 | 226 | 631 | 362 | 357 |
| 2) PIO 8 | 600 | 156 | 132 | 198 | 222 | 177 |
| 3) A | 370 | 106 | 50 | 22 | 94 | 68 |
| 4) A + PIO8 | 370 + 230 | 16 | 52 | 0 | 0 | 17 |
| 5) A + PIO8 | 370 + 230 | 14 | 3 | 10 | 16 | 11 |
| 6) A + PIO6 | 370 + 230 | 35 | 103 | 27 | 23 | 47 |

The data of table 2 show how the PIO 8 alone reduces the quantity of valve deposits (test 2 compared to test 1).

In addition PIO 8 shows excellent cleansing properties when mixed with normal commercial additives (tests 4 and 5 compared to the previous ones).

This effect is shown, although to a lesser degree, also by fraction PIO 6, or the product before the fractionation phase on a fine film evaporator.

We claim:

1. Fuel composition for internal combustion engines which comprises a larger portion of fuel and a smaller quantity of almost totally saturated hydrocarbon oligomers having a degree of unsaturation of less than about 10% wherein the composition of almost totally saturated hydrocarbon oligomers:

(1) is obtained by the oligomerization and subsequent hydrogenation of a hydrocarbon composition comprising $C_{15}$–$C_{18}$ internal oligomers, in a quantity of more than 90% by weight;

(2) is without hydrocarbons having a number of carbon atoms equal to or less than 13; and (3) has a viscosity at 100° C. of between 5.0 and 12.0 cst.

2. Composition according to claim 1, wherein the almost totally saturated hydrocarbon oligomers derive from the oligomerization and subsequent hydrogenation of compositions of $C_{15}$–$C_{16}$ internal olefins.

3. Composition according to claim 1, wherein the almost totally saturated hydrocarbon oligomers have a viscosity at 100° C. of between 7.3 and 8.4 cSt.

4. Composition according to claim 1, wherein the almost totally saturated hydrocarbon oligomers are present in a quantity of between 100 and 1200 ppmw (parts per million by weight).

5. Composition according to claim 4, wherein the almost totally saturated hydrocarbon oligomers are present in a quantity of between 200 and 800 ppmw.

6. Composition according to claim 1, wherein the fuel has a boiling point within the temperature range of gasoline, and consists essentially of saturated, olefinic and aromatic hydrocarbons.

7. Composition according to claim 1, additionally containing detergent additives.

8. Composition according to claim 7, wherein the detergent additives are selected from:

1) polyisobutenylsuccinimides, 2) oil-soluble aliphatic polyamines having the general formula (I)

$$H(R)N\text{-}R'\text{—}(NH\text{-}R')_x\text{—}N(R'')_2 \quad (I)$$

wherein R is a polyolefinic chain, R' is an alkylenic chain with from 1 to 8 carbon atoms, R" is hydrogen or a lower alkyl, x is from 0 to 5.

9. Compostion according to claim 8, wherein R is a polyisobutene chain with a molecular weight of between 600 and 1,300, R' is an alkylenic chain with 3 carbon atoms, R" is methyl, x is zero.

10. Concentrate suitable for being added to a fuel composition comprising a diluent soluble in the fuel itself and the composition of almost totally saturated hydrocarbon oligomers according to claim 1, and optionally one or more detergent additives.

11. Concentrate according to claim 10, wherein the detergent additive is selected from:

1) polyisobutenylsuccinimides, 2) oil-soluble aliphatic polyamines having the general formula (I)

$$H(R)N\text{-}R'\text{—}(NH\text{-}R')_x\text{—}N(R'')_2 \quad (I)$$

wherein R is a polyolefinic chain, R' is an alkylenic chain with from 1 to 8 carbon atoms, R" is hydrogen or a lower alkyl, x is from 0 to 5.

12. Concentrate according to claim 10, which comprises from 20 to 80% by weight of almost totally saturated hydrocarbon oligomers, from 1 to 30% of oil-soluble polyamine and from 1 to 30% of diluent.

* * * * *